United States Patent [19]

Barker

[11] Patent Number: 4,609,018

[45] Date of Patent: Sep. 2, 1986

[54] SAW-SPLITTER MACHINE

[76] Inventor: Thomas L. Barker, 80 Owl Creek Rd., Sheridan, Wyo. 82801

[21] Appl. No.: 719,238

[22] Filed: Apr. 2, 1985

[51] Int. Cl.[4] ..... B27L 7/00

[52] U.S. Cl. ..... 144/3 K; 83/708; 144/193 R; 144/366; 221/275; 221/301

[58] Field of Search ..... 144/3 K, 193 R, 366, 144/367; 83/708, 417, 436, 928; 221/275, 301

[56] References Cited

U.S. PATENT DOCUMENTS

| | | | |
|---|---|---|---|
| 1,041,272 | 8/1911 | Howard | 144/3 K |
| 1,099,221 | 6/1914 | Weber | 83/708 |
| 1,864,840 | 6/1932 | Lehner | 144/287 |
| 4,160,470 | 7/1979 | Sigmund | 144/3 K |
| 4,176,696 | 12/1979 | Greeninger | 144/3 K |
| 4,269,242 | 5/1981 | Smith et al. | 144/3 K |
| 4,284,112 | 8/1981 | Hoskin | 144/3 K |
| 4,478,263 | 10/1984 | Johnston | 144/3 K |

FOREIGN PATENT DOCUMENTS

| | | | |
|---|---|---|---|
| 1028933 | 4/1978 | Canada | 144/3 K |

*Primary Examiner*—W. D. Bray

*Attorney, Agent, or Firm*—Berman, Aisenberg & Platt

[57] ABSTRACT

An apparatus for cutting wood is disclosed wherein a trailer provides an operator station at one end and a plurality of components for automatically cutting and splitting wood into fireplace-sized pieces. A boom arm is controlled by the operator to load logs onto a log deck. The log deck includes two parts which may be telescoped together during transportation and extended to receive long logs during operation. Cams allow a single log to be loaded onto a set of rollers which advances the log into a cutting station. The cutting station includes additional rollers for engaging the sides of the log and driving it to a predetermined location. Then, the saw automatically cuts the log and the cut piece is released to fall into a splitting section. A sensor detects when the log is in the splitting section and a hydraulic ram is activated to split the log into pieces. The pieces then fall down a slanted plate onto a conveyor belt for loading into a truck. If it is desired not to split the wood, an intercepting chute is moved into a location between the cutting station and the splitting station to direct unsplit logs onto the conveyor. The apparatus is operated by an engine which drives a hydraulic pump to power a number of hydraulic motors which operate the various parts of the apparatus. Once a log has engaged the rollers associated with the cutting station, operation is essentially automatic, thus allowing the operator to obtain additional logs and place them on the log deck.

14 Claims, 29 Drawing Figures

FIG. 25.
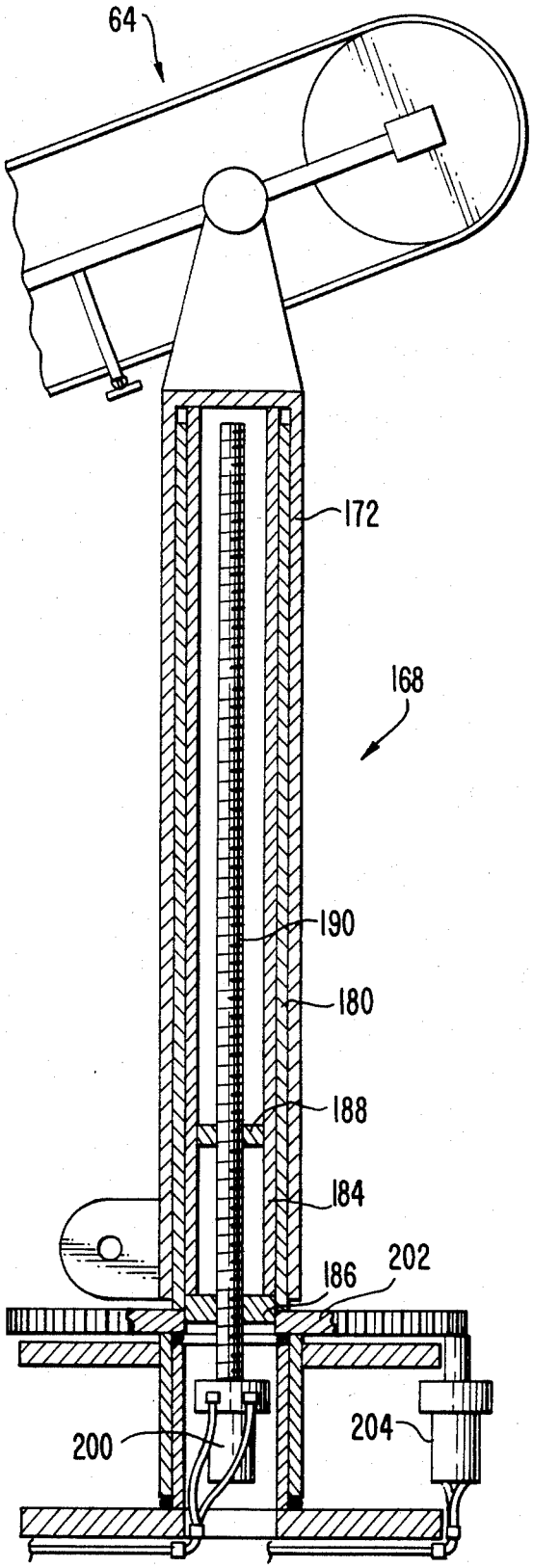
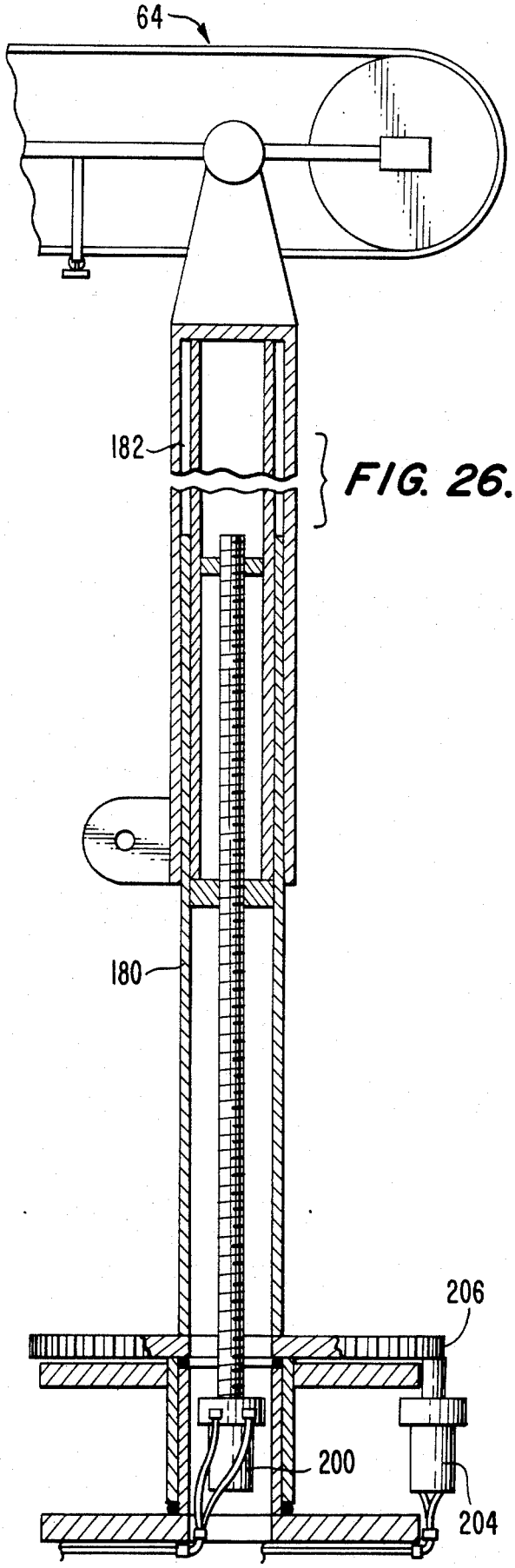
FIG. 26.

SAW-SPLITTER MACHINE

TECHNICAL FIELD

The invention relates to the art of machines for cutting logs into smaller pieces. The machine finds particular utility in cutting logs into fireplace-length pieces and then splitting these pieces.

BACKGROUND ART

The typical process of providing firewood comprises sawing logs into a plurality of pieces having lengths appropriate for use in a fireplace or wood stove. Then, each of these pieces is split by the use of a maul or wedge to provide smaller, more convenient pieces.

Since the process of cutting and splitting is quite time consuming, it is known to provide machines for assisting in this process. For example, it is known to provide machines such as that shown in U.S. Pat. No. 1,001,272 (Howard) for cutting a log into a plurality of pieces and splitting the logs by a power hammer. U.S. Pat. No. 4,076,061 (Greeninger) teaches a machine for cutting a log into smaller pieces which employs a winch to pull a tree into a cutting station. The cut pieces of the tree fall into a splitting station wherein they are split into smaller pieces. U.S. Pat. No. 4,160,470 (Sigmund) teaches a device having a boom arm for loading logs into a cutting machine. Sigmund provides for a certain degree of automatic control wherein sensors for determining the location of a log control the operation of various elements of the apparatus. U.S. Pat. No. 4,219,057 (Falk) teaches a circular saw blade for cutting a log and means for forcing the cut pieces against a wedge for splitting them.

SUMMARY OF THE INVENTION

In accordance with the invention, an apparatus is provided which is portable and provides essentially automatic cutting and splitting of a log into fireplace-sized pieces. The various components are preferably mounted on a trailer which can be easily pulled to the location of the logs to be split and easily set up. The various components are compactly arranged on the trailer and may be easily moved to the operational position from the travelling position. A log deck which receives logs prior to their being cut is extensible so that the apparatus is capable of sawing extremely long logs and may be conveniently shortened for travelling.

A control panel is located at one end of the trailer to allow an operator to observe the entire operation of the machine and to load logs from a pile onto the machine.

A boom arm includes a grasping element for picking up a log and placing it on a log deck. The log deck is a slanted surface having cams for allowing a single log at a time to be placed on a plurality of hourglass-shaped rollers. The rollers are driven by a motor to advance a single log into a cutting station. When a log has been advanced into a cutting station, additional rollers engage it, and the subsequent operation is automatic.

A sensor determines the presence of a log in the cutting station. If a log is not fully in the cutting station, motors are activated to cause rollers to drive the log until it is in the proper cutting position. In the preferred embodiment, a photocell detects the presence or absence of a light beam, and a log blocks the light beam when it is in the proper cutting position. When the log is in the proper position, a saw is activated to cut a piece from the log. This piece then falls downwardly into a splitting area which automatically splits the log. The split piece then falls onto a conveyor for eventual loading onto a truck.

The saw is preferably a circular saw mounted for pivotal rotation along a path which includes the log to be cut. A sensor detects the rotational velocity of the saw and feeds a control signal to a hydraulic cylinder which controls the position of the saw so that the speed at which the saw is advanced through the log is reduced if the rotational velocity of the saw blade is reduced. This allows the speed of the saw blade to be kept essentially constant.

If it is not desired to split the cut pieces, a chute is slid into position between the cutting station and the splitting station to intercept the cut logs and direct them away from the splitting station. The chute is mounted for sliding movement on sidewalls of the splitting station so that it may be easily controlled by a hydraulic cylinder.

It is an object of this invention to provide a portable machine for automatically cutting a log into a plurality of pieces.

A further object of this invention is to provide a machine for cutting a log into a plurality of pieces and splitting the pieces, wherein the cutting and splitting operations are automatic.

Another object of this invention is to provide an apparatus having a unique combination of elements to permit a plurality of operations to be performed and yet to be collapsible to provide an easily-transported machine.

Figure 6:
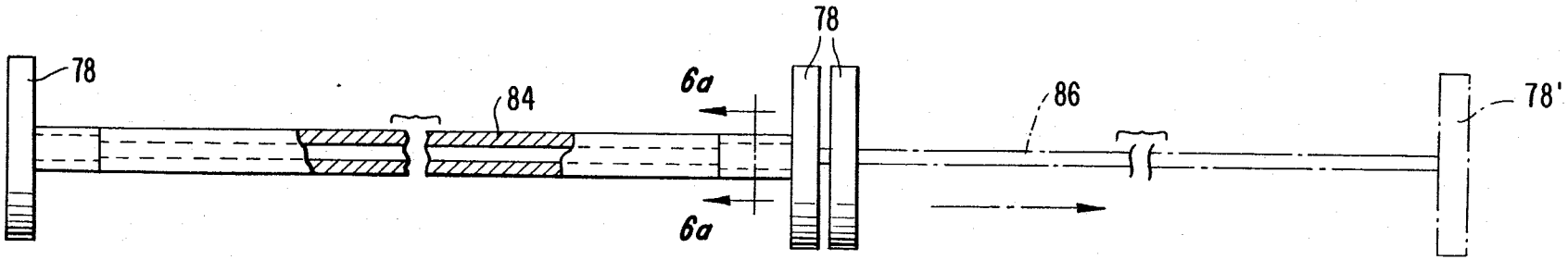
FIG. 6 is a side view, having partially cut-away portions, of a cam drive mechanism in accordance with the invention.

FIG. **6*a* is a cross section taken along line 6*a*—6*a* of FIG. 6**.

FIGS. **6*b* and 6*c*** show top and side views of a mechanism to extend and retract the rear part of the log deck.

Figure 7:
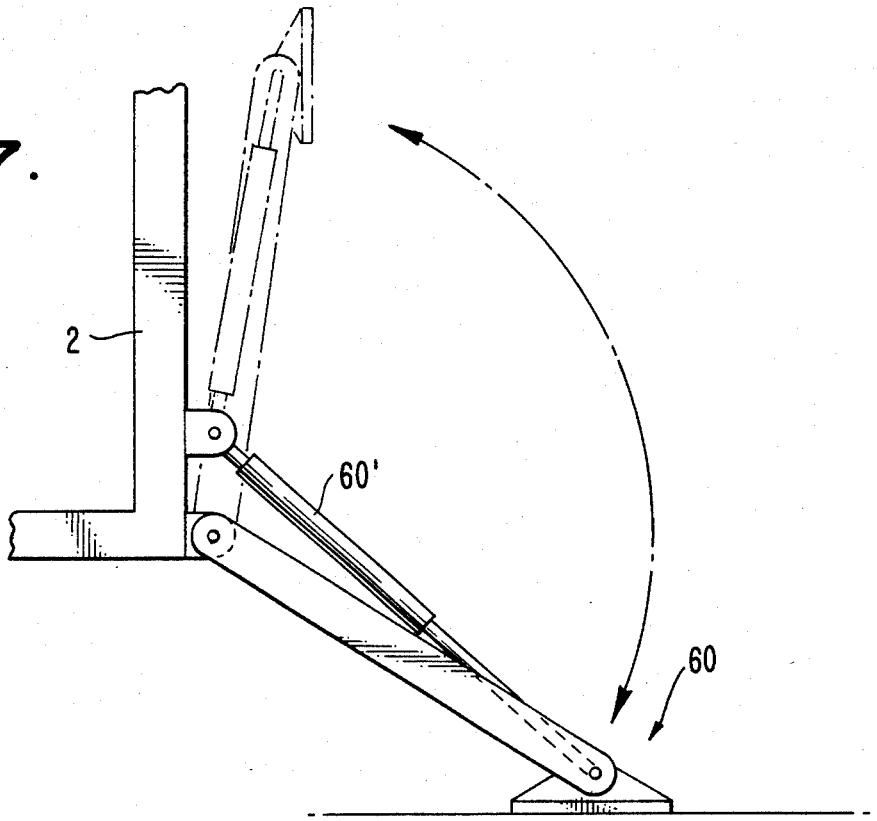

FIG. 7 illustrates the operation of a stabilizing pad used with the apparatus of the invention.

Figure 1:
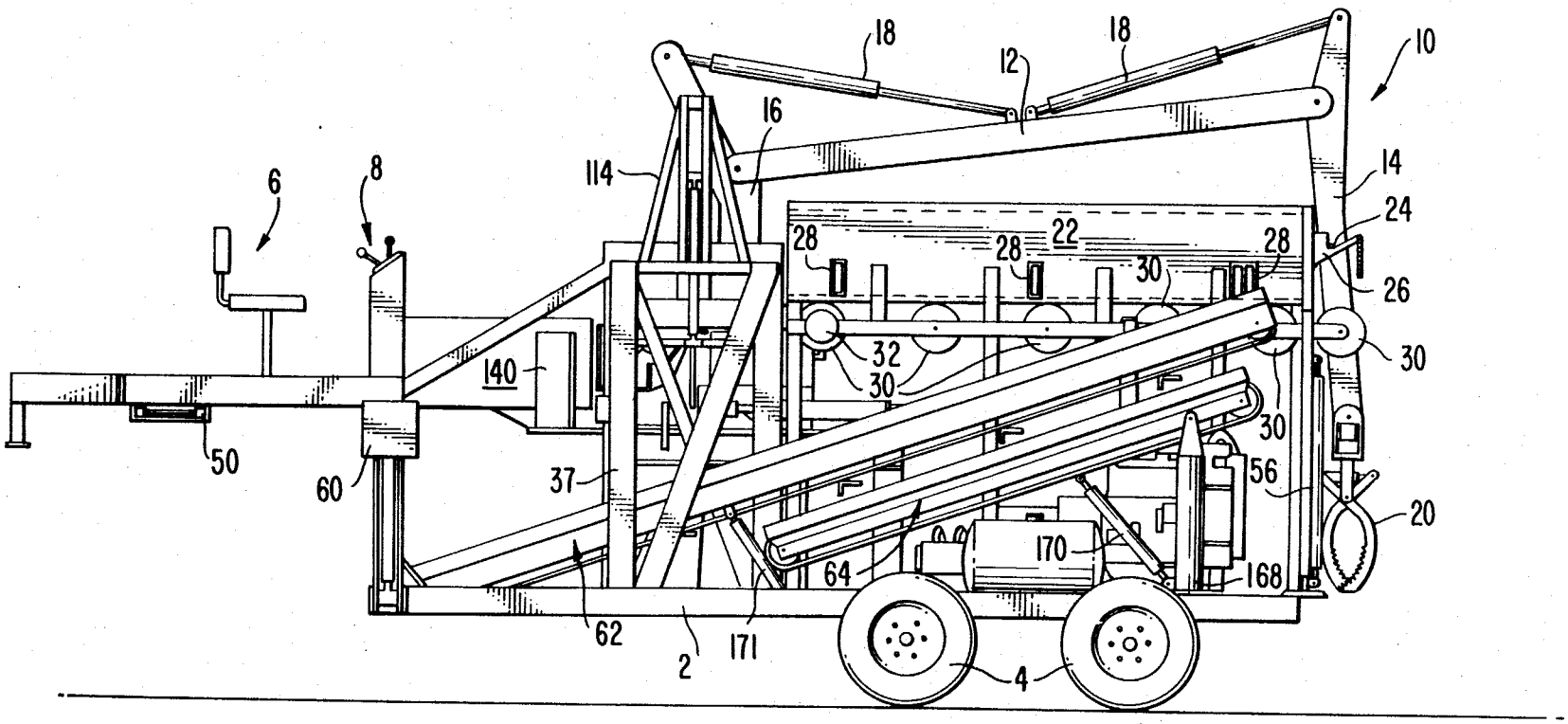
FIG. 1 is a side view of an apparatus in accordance with the invention in its easily-transportable configuration.
Figure 8:
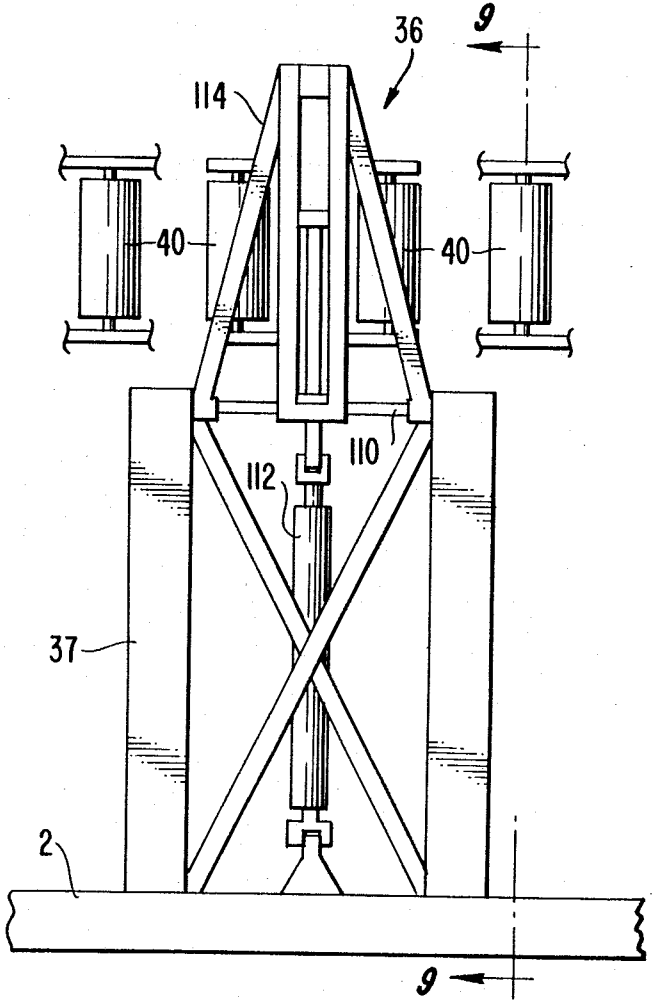

FIG. 8 is a side view of the cutting station of the machine shown in FIG. 1.

Figure 9:
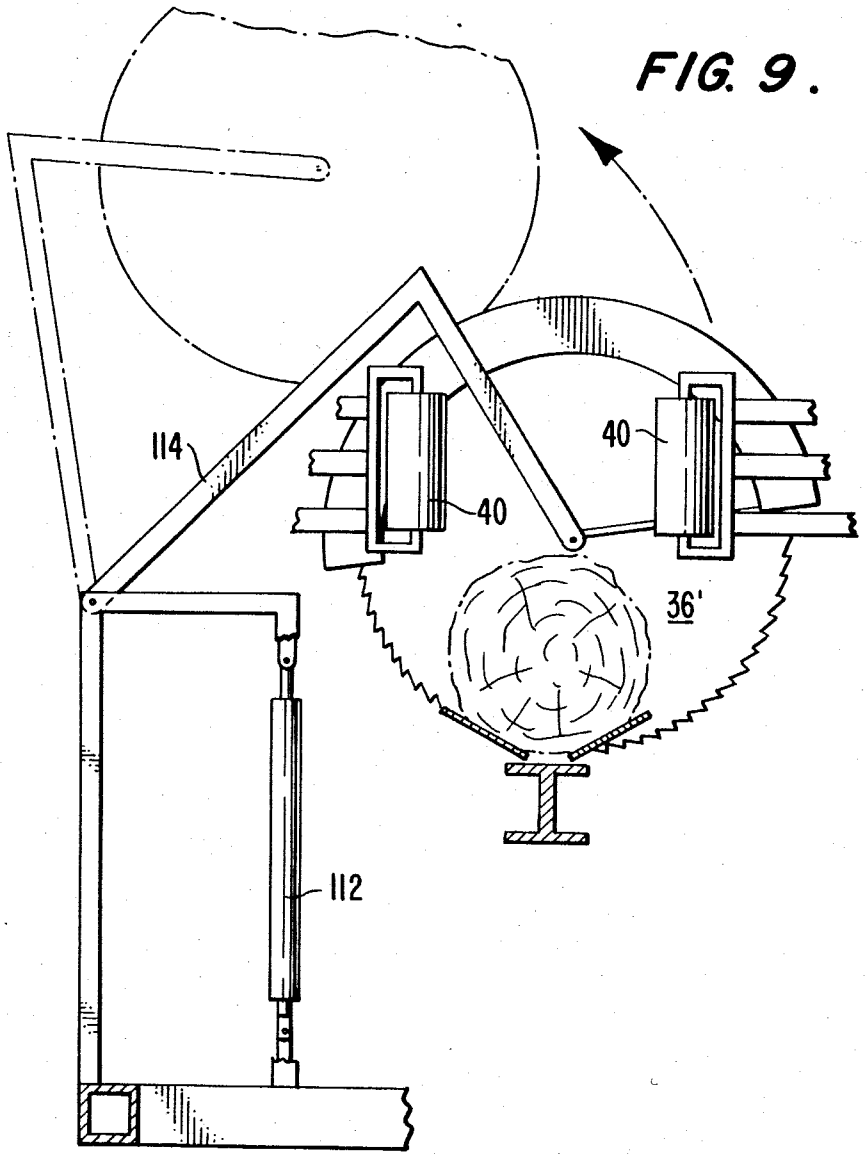

FIG. 9 is an end view of the cutting station of the machine shown in FIG. 1.

Figure 10:
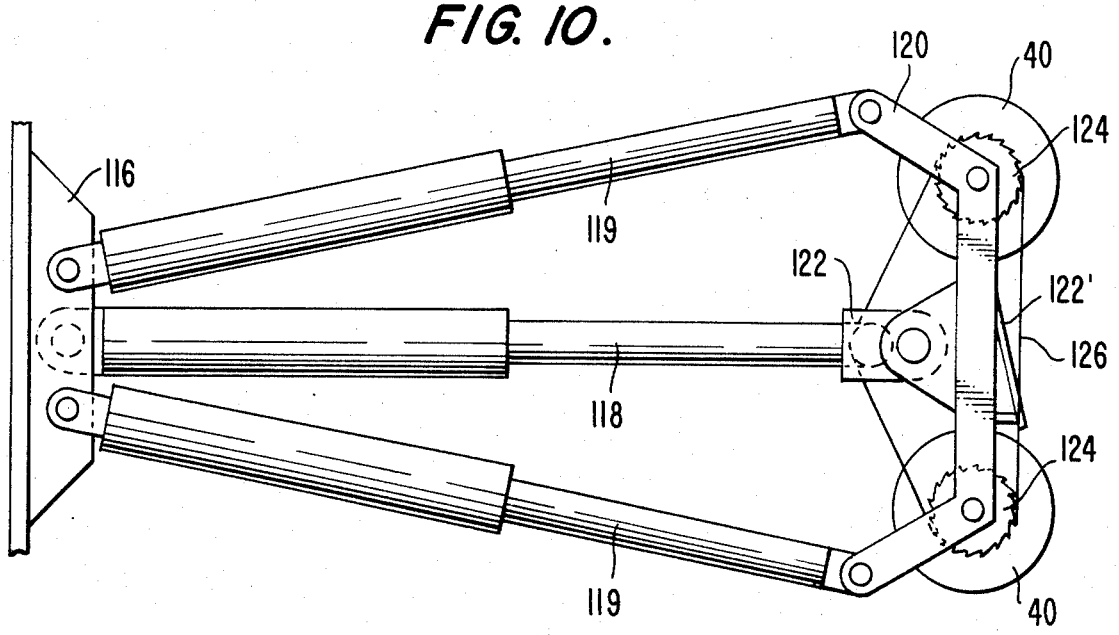

FIG. 10 is a top view of drive rollers used to drive a log.

Figure 11:
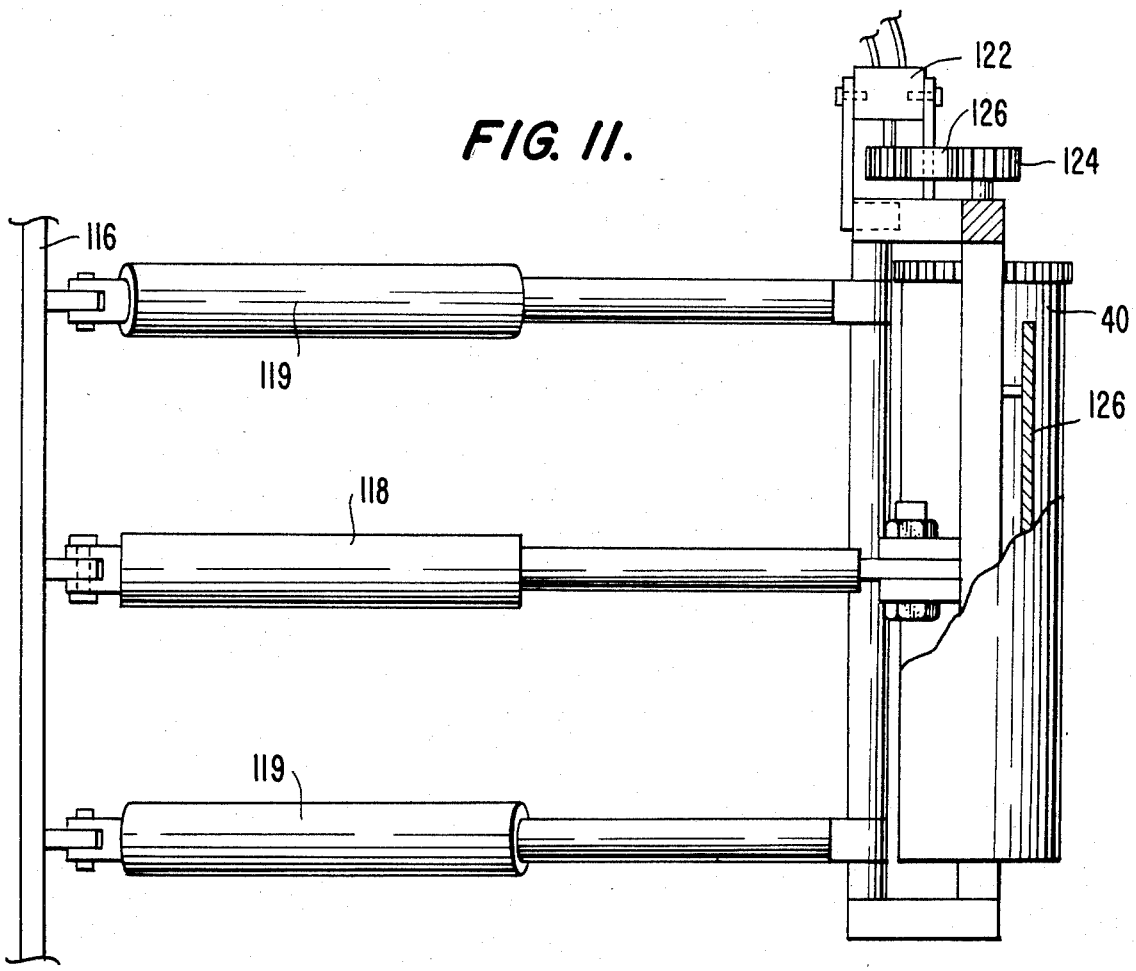

FIG. 11 is a side view, shown partially cut-away, of the apparatus shown in FIG. 10.

Figure 12:
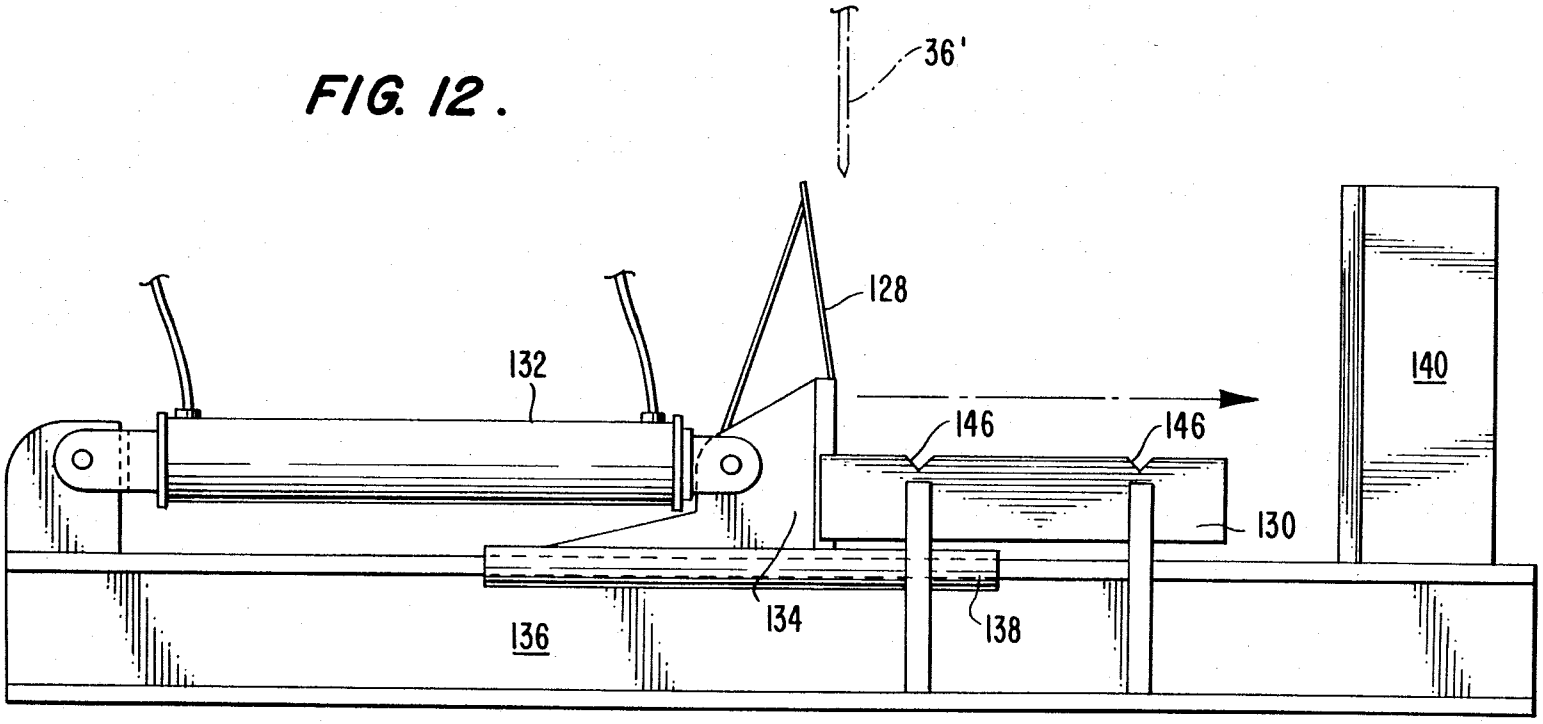

FIG. 12 is a side view of a splitter in accordance with the invention.

Figure 13:
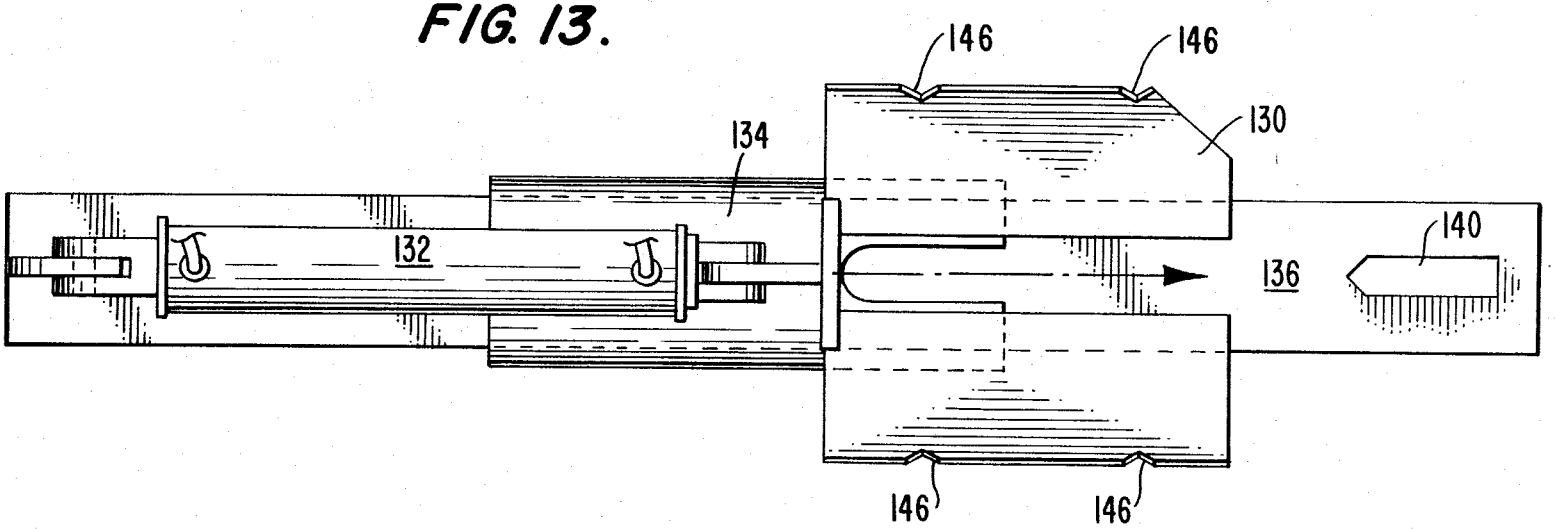

FIG. 13 is a top view of the splitter shown in FIG. 12.

Figure 14:
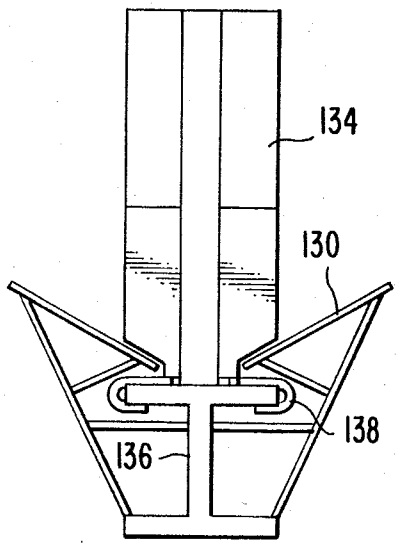

FIG. 14 is an end view of the splitter shown in FIG. 13.

Figure 15:
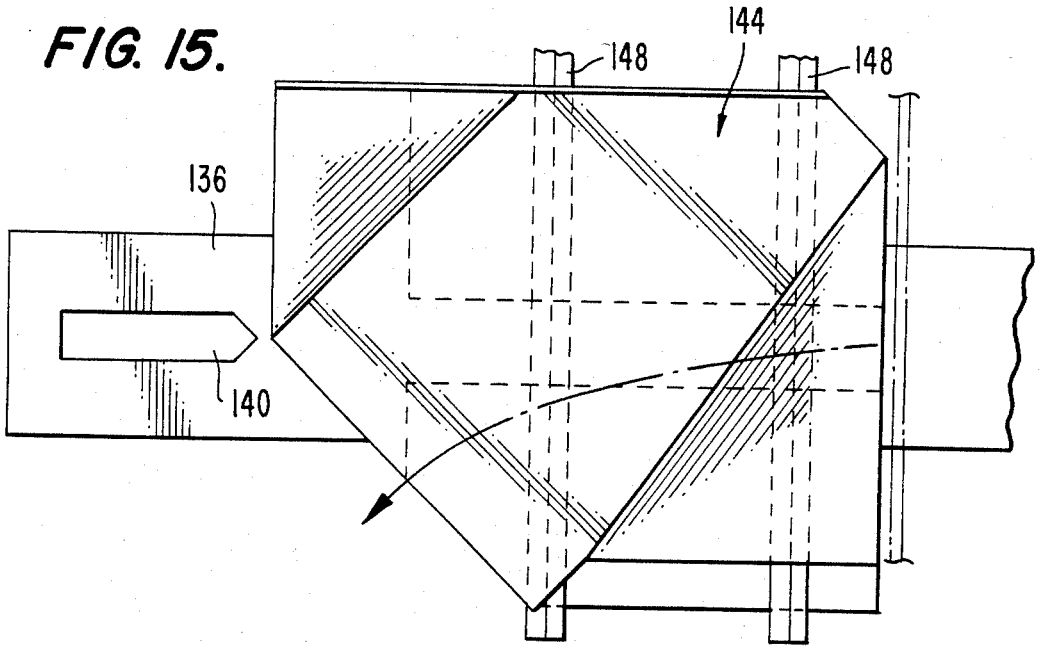

FIG. 15 is a top view of a chute used to direct cut pieces away from the splitter section.

Figure 16:
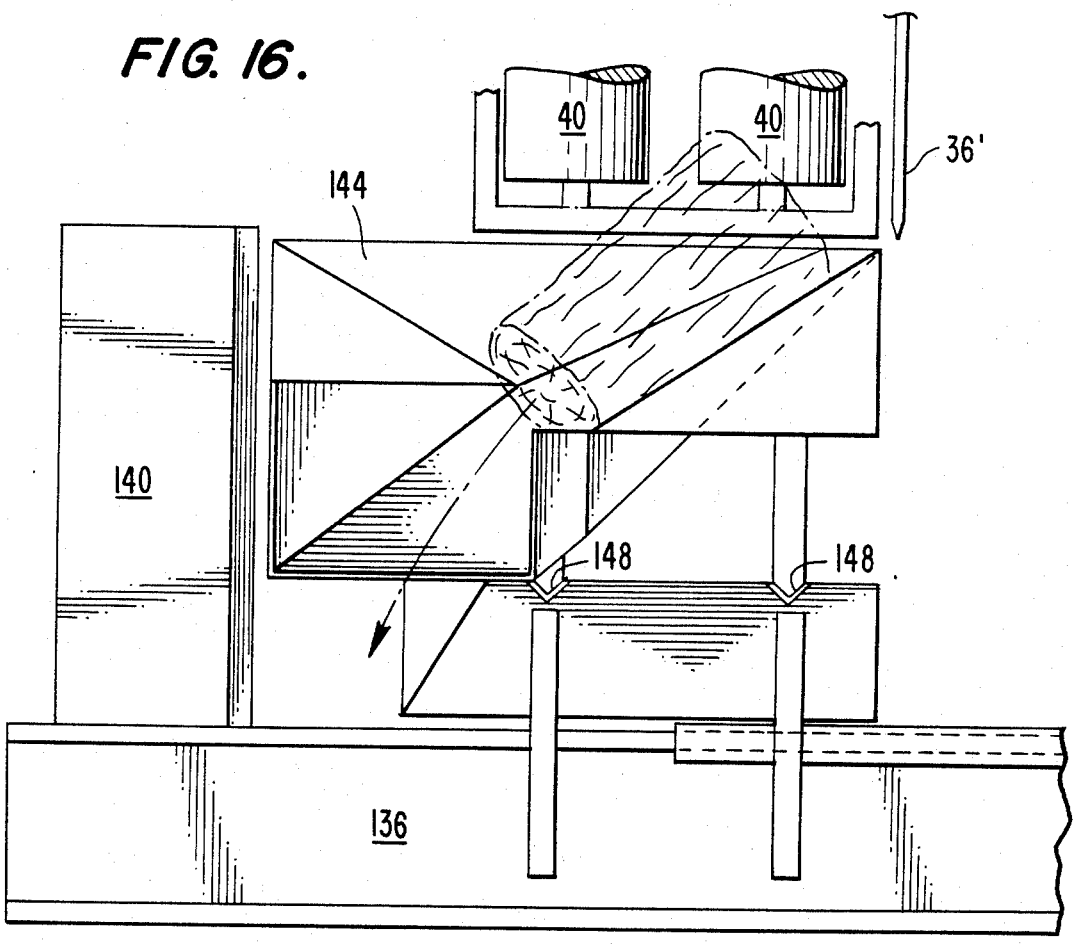

FIG. 16 is a side view of the chute shown in FIG. 15.

Figure 17:
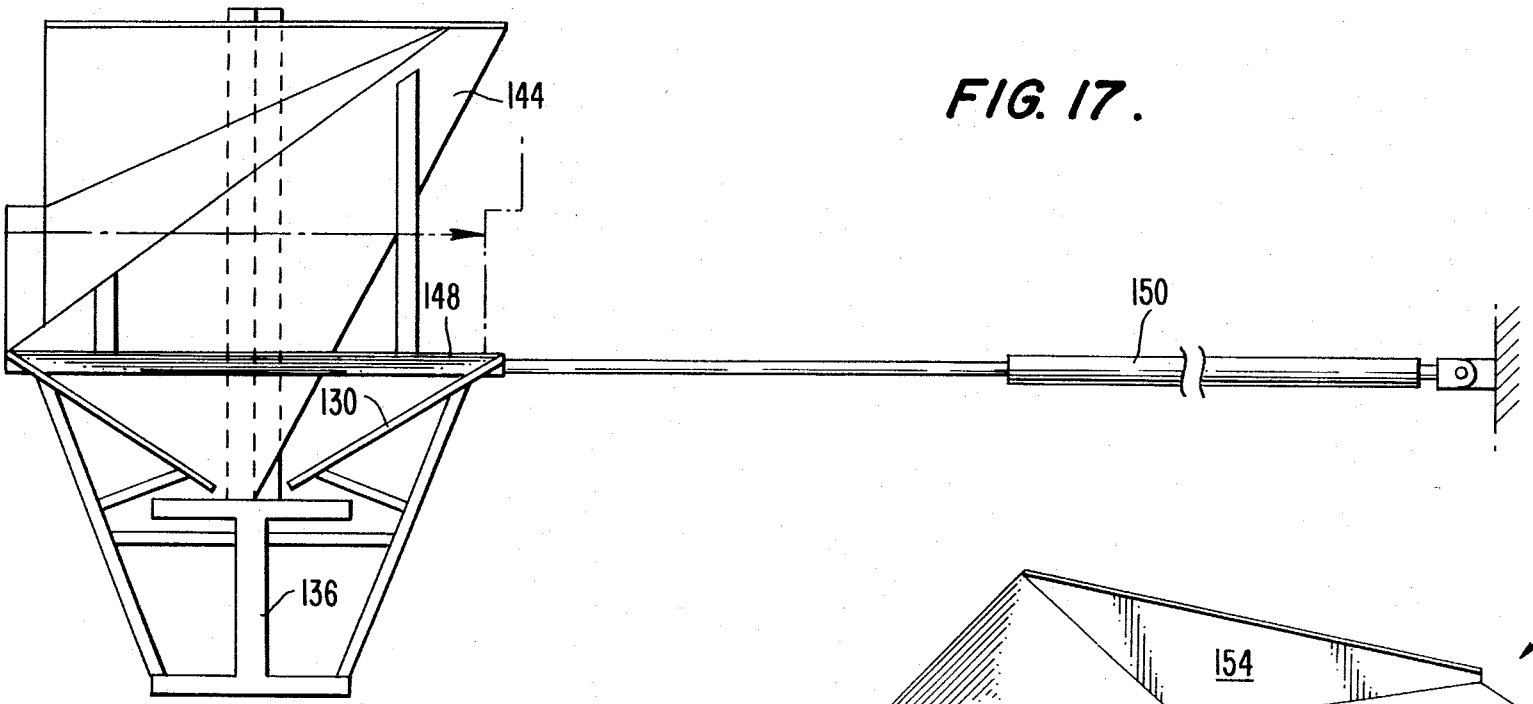

FIG. 17 is a side view of a mechanism for altering the position of the chute shown in FIG. 15.

Figure 18:
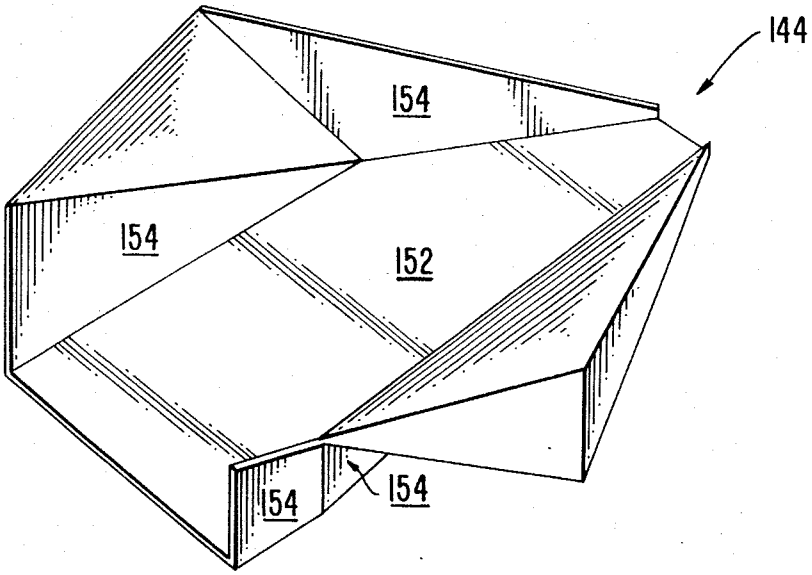

FIG. 18 is a perspective of the chute of FIG. 15.

Figure 19:
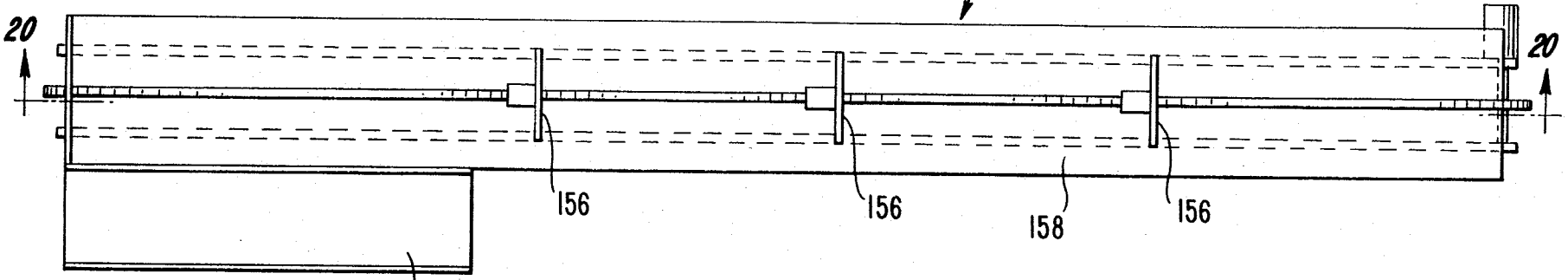

FIG. 19 is a top view of a conveyor in accordance with the invention.

Figure 20:
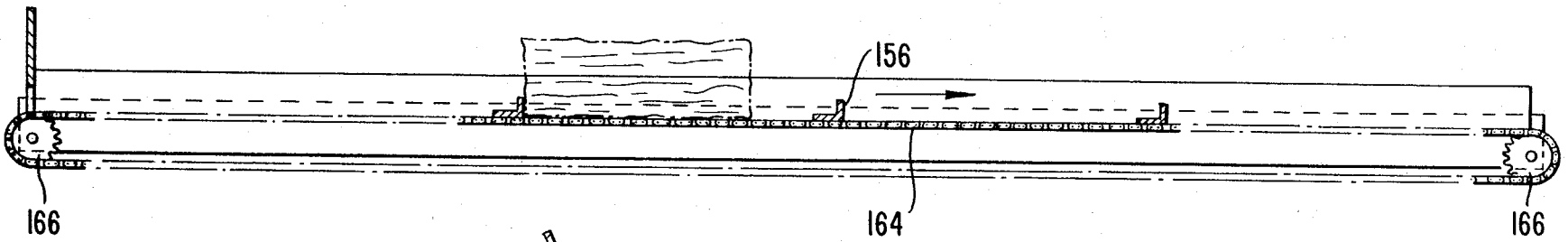

FIG. 20 is a cross section taken along line 20—20 of FIG. 19.

Figure 21:
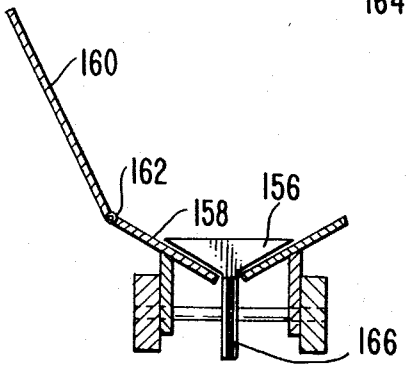

FIG. 21 is an end view of the apparatus shown in FIG. 20.

Figure 22:
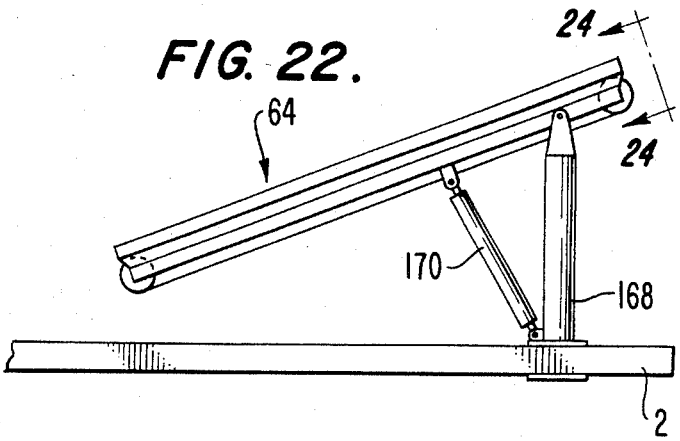

FIG. 22 is a side view of a second conveyor in its transportable position.

Figure 23:
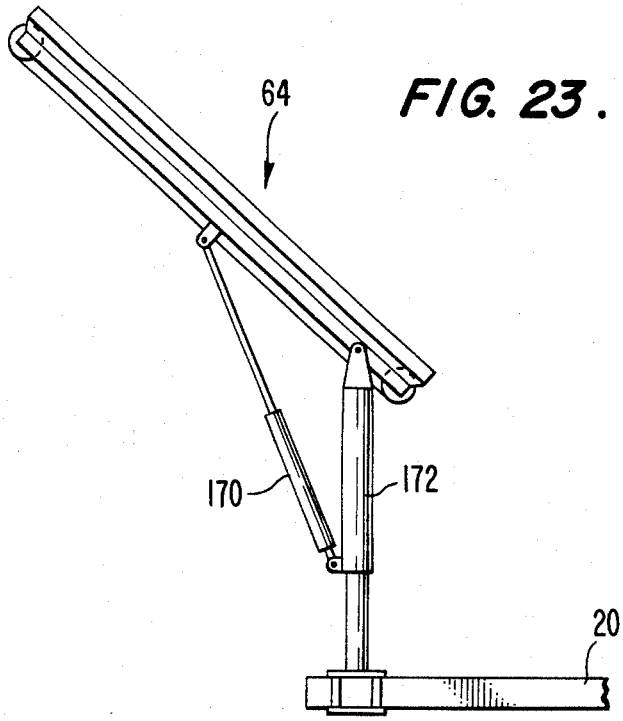

FIG. 23 is a side view of the conveyor shown in FIG. 22 in an operational position.

Figure 24:
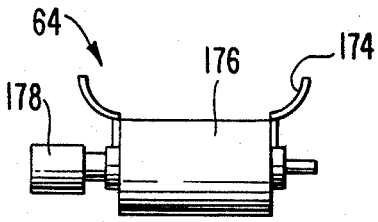

FIG. 24 is an end view along line 24—24 of FIG. 22.

FIG. 25 is a cross section of the rotational and height-adjusting mechanism of the apparatus shown in FIG. 22 in its lowered position.

FIG. 26 is a cross section of the mechanism shown in FIG. 25 in an expanded position.

DETAILED DESCRIPTION OF THE DRAWINGS

FIG. 1 is a side view of an apparatus in accordance with the invention designed to be easily portable and yet to combine a plurality of components which permits a single operator to process a large amount of wood.

The various components are mounted on a frame 2 which includes a lower portion having axles and wheels 4 and an upper portion having an operator's chair 6 and a control station 8.

The apparatus shown in FIG. 1 is preferably pulled to a given location and placed into an operational configuration which will be more fully described below. It should be noted that the boom 10 includes arm 12 and arm 14 which are pivotally connected to each other and to a base 16 which is in turn pivotally mounted to the frame 2. Hydraulic cylinders 18 control the operation of arms 12 and 14 to allow the operator to direct a grasping element 20 to a location where logs are stacked, to engage a single log and to place it on a log deck 22. Boom 20 is easily stored because arm 12 has a length essentially equal to the distance between base 16 and the end of the apparatus when in the travelling position shown in FIG. 1.

Figure 2:
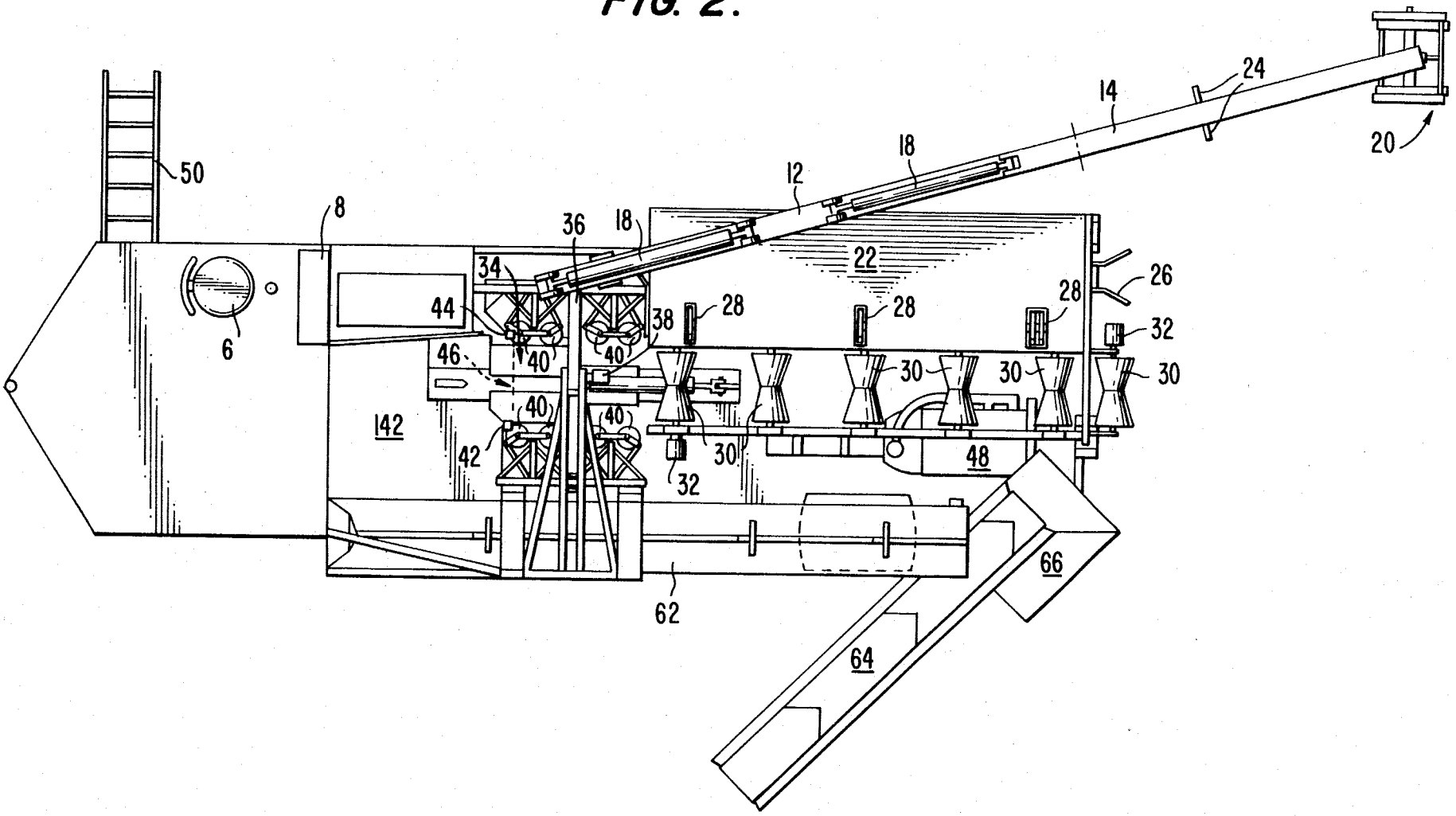
FIG. 2 is a top view of the apparatus of the invention in an operational configuration.

FIG. 2 is a top view of the apparatus of FIG. 1 when in an operating configuration. It will be appreciated that pins 24 extend outwardly from arm 14. In the travelling configuration shown in FIG. 1, these pins engage a support bracket 24 which receives the weight of the boom 10 when the hydraulic cylinders 18 are deactivated. In order to place the boom in an operational position, it is only necessary to activate the hydraulic cylinders to raise arm 14 to remove pins 22 from the support bracket. FIG. 2 shows the log deck 22 in a shortened configuration, but it will be appreciated that the log deck is preferably expanded to accomodate longer logs as will be more fully explained with respect to FIG. 3.

Log deck 22 is slanted and includes apertures 28 for allowing log-releasing cams to extend therethrough. The operator places a plurality of logs on the log deck 22 and selectively releases a single one onto hourglass-shaped rollers 30. At least two of the rollers 30 are driven by motors such as that shown at 32 to drive a log located on the rollers 30 along a path defined by the rollers. The motors 32 may be either electric, hydraulic, or the like. Located forwardly of the hourglass-rollers 30 is a cutting station 34 which comprises a saw 36 and drive rollers 40. The saw is preferably a circular saw driven by a motor 38 which is preferably hydraulic.

Adjacent the saw 36 are a plurality of driver rollers 40 mounted to devices for allowing their movement in a direction transverse to the path defined by the hourglass rollers 30, as will be more fully described below.

At the end of the cutting station 34 are a light source 42 and photodetector 44. Light source 42 produces a light beam 46 which extends across the path of the log. Photodetector 44 is connected to a circuit in control station 8 whereby when the beam 46 is broken, saw motor 38 is activated to cut the log. Then, the group of rollers to the left of the saw releases the log, and the cut piece falls downwardly as will be more fully described below, thus allowing beam 46 to again be established. Then, the group of rollers to the right of the saw is activated to drive a log forwardly until the beam is again broken, thus reactivating the saw motor 38.

An engine 48, such as a diesel engine, is provided for driving a hydraulic pump to power the hydraulic system and to generate electricity for electric motors and control electronic control systems.

FIG. 2 also shows a ladder 50 which allows an operator to climb to the operator's area, and this ladder is easily stored in a bracket attached to frame 2.

Figure 3:
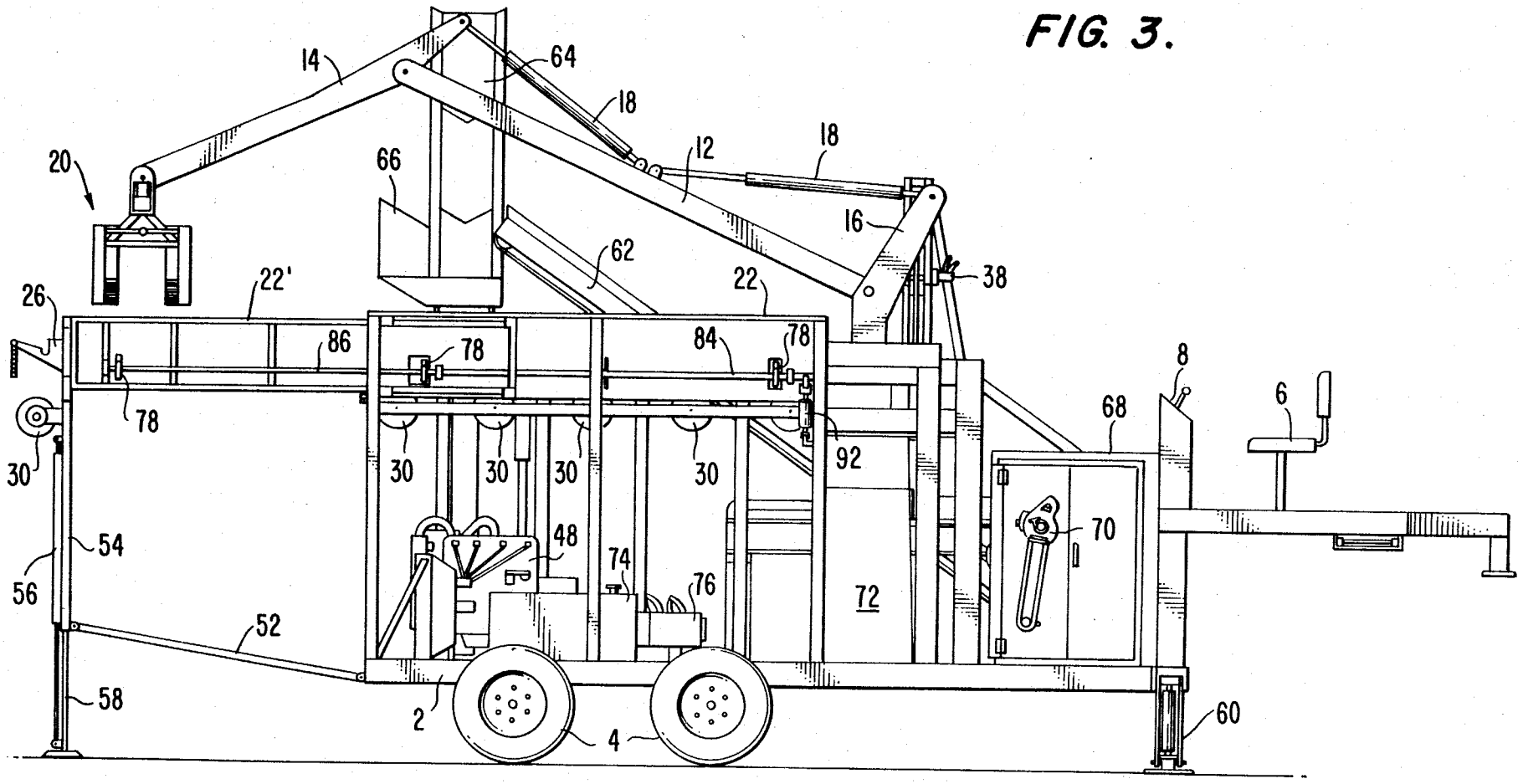
FIG. 3 is a side view opposite that of FIG. 1 showing the apparatus in an operational configuration.

FIG. 3 shows the apparatus of the invention in the fully operational position. It will be noted that an extendable portion 22′ of the log deck has been moved rearwardly of the apparatus to provide a log deck of substantial total length. A bracket 52 extends from the frame 2 to a rear part 54 of the extendable portion to provide rigidity. A hydraulic cylinder 56 operates to extend a support pad 58 downwardly to engage the ground to support the rear part of the extendable portion 22′. In addition, support pads 60 are extended from forward portions of the frame for additional support.

FIG. 3 also shows a first conveyor 62 in an operative orientation emptying into a second conveyor 64, which has been rotated from the stored orientation shown in FIG. 1, and where its discharge end has been raised to load cut and split wood into a truck. Conveyor 64 also has hopper plates 66 installed at one end of the conveyor to catch wood from the discharge end of the first conveyor 62. The frame 2 also carries a storage locker 68 having room for equipment, such as a chain saw 70.

A chute 72, for receiving unsplit wood from a moveable chute placed between the cutting section and the splitting section, is carried as shown in FIG. 3. This will be more fully described below with respect to FIG. 17.

FIG. 3 more clearly shows a fluid reservoir 74 and a hydraulic pump 76 which are operatively associated with engine 48.

Figure 4:
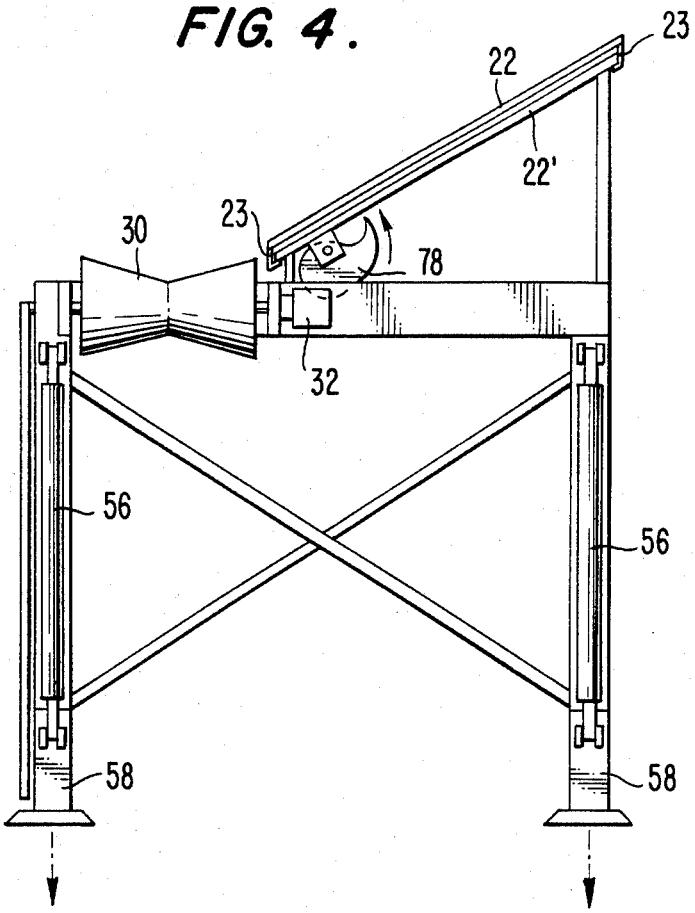
FIG. 4 is an end view of a log deck portion of the invention.

FIG. 4 is an end view of the log deck 22 and shows how extensible deck 22′ lies beneath deck 22 and how both are slanted with respect to the horizontal. Brackets 23 allow extensible part 22′ to slide with respect to stationary part 22. A plurality of cams 78 are mounted on an extensible shaft and each is associated with an aperture 28 (see FIG. 2) to allow a single log to advance from the log deck onto the plurality of rollers 30.

Figure 5:
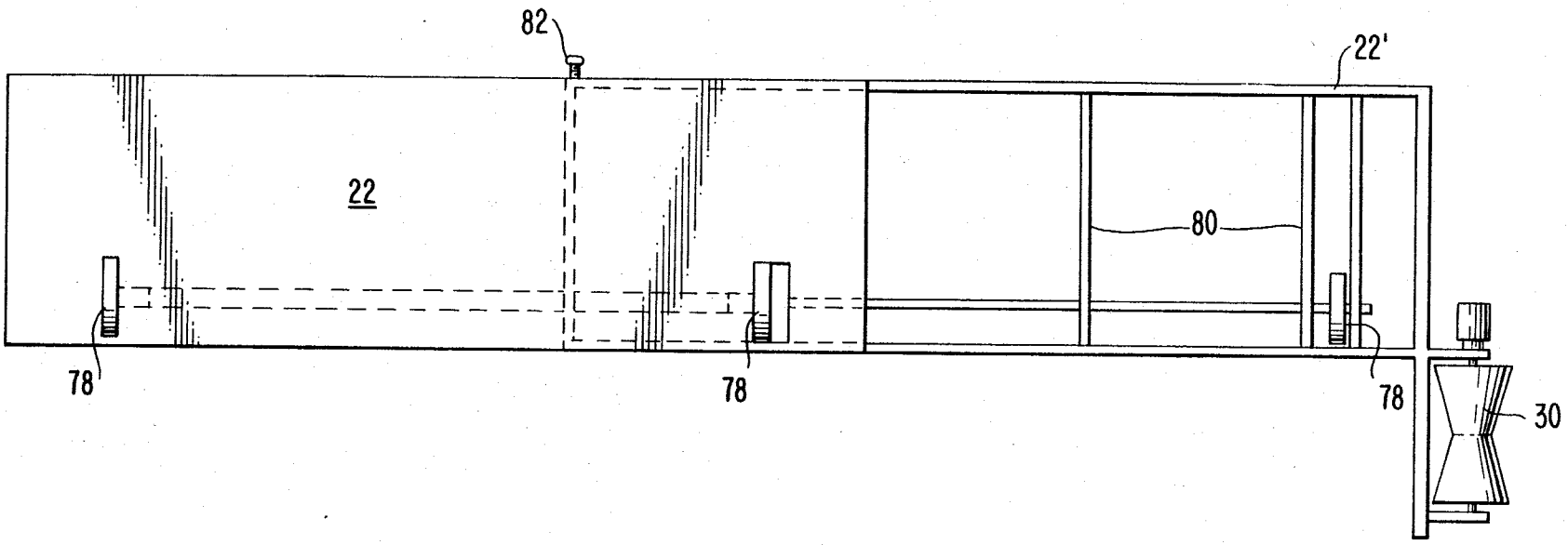
FIG. 5 is a top view of the log deck.

With reference to FIG. 5, it will be seen how the extensible part of the deck 22′ slides with respect to the stationary part of the log deck. Furthermore, the extensible part need not have a solid surface, but may instead merely comprise a plurality of braces 80. A stop 82 secures the extensible part 22′ to the fixed part 22 during transportation of the apparatus.

FIG. 6 shows how cams 78 are connected together and a movable cam 78′ associated with it. Two cams are attached to a hollow shaft 84, and cam 78′ is attached to a small shaft 86 which fits within the hollow part of hollow shaft 84. Thus, when the extensible portion 22′ is pulled outwardly, cam 78′ which is attached to the smaller shaft 86 will move outwardly also.

Figure 6A:
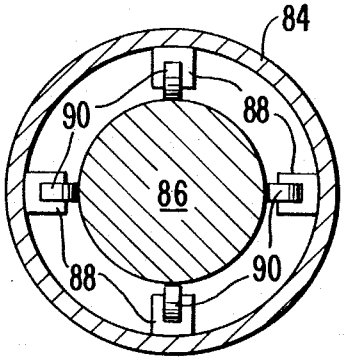

FIG. 6*a* illustrates how hollow shaft 84 is secured to smaller shaft 86 so that they rotate together. A plurality of channels 88 is mounted to the interior wall of hollow shaft 84, and smaller shaft 86 has a plurality of ridges 90 which cooperates with the channels 88 to allow sliding relative motion.

With reference to FIG. 3, it will be appreciated that hollow shaft 84 is driven in rotation by hydraulic cylinder 92 and that rotation of shaft 84 causes rotation of shaft 86.

Figure 6B:
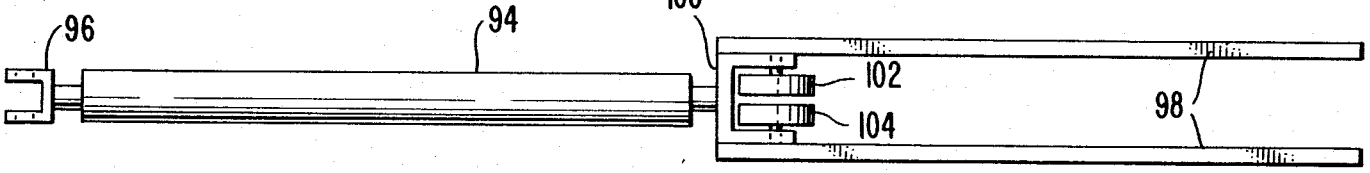
Figure 6C:
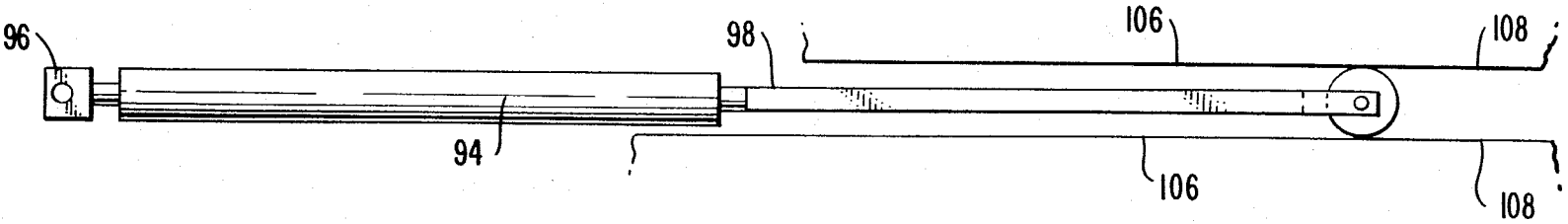

FIGS. 6*b* and 6*c* illustrate the preferred manner of driving the extensible portion 22′ outwardly and inwardly. FIG. 6*b* is a top view a hydraulic cylinder 94 which is attached at an end 96 to the frame of the apparatus. A U-shaped track 98 is also attached to the frame and provides a channel for movement of an end 100 of the hydraulic cylinder which carries two pulleys 102 and 104.

FIG. 6*c* is a side view showing cables 106 and 108. One end of cable 106 is attached to the extensible portion 22′, and an opposite end is attached to the frame. A similar arrangement is provided for cable 108. Thus, as the end 100 is driven to the right of FIG. 6*c* by the action of the hydraulic cylinder 94, the extensible portion 22′ will be driven outwardly by action of cable 106. When the end 100 is driven to the left of FIG. 6*c*, extensible portion 22′ will be pulled inwardly by action of cable 108.

FIG. 7 illustrates how the support pad 60 is pivoted by a hydraulic cylinder 60′ to cause it to move from a travelling position (phantom lines) to an operational position.

FIG. 8 is a partial side view of the apparatus of the invention and shows the cutting station in more detail. Saw 36 is mounted on a stand 37 for rotation about a shaft 110, and a hydraulic cylinder 112 is attached to a portion of a frame 114 which supports the saw motor.

FIG. 9 illustrates how the frame 114 is pivoted downwardly so that saw blade 36′ is caused to cut through a log. Rollers 40 are mounted on opposite sides of the path defined by rollers 30 to engage a log and pull it into the cutting station as described above. When the saw has cut through the log (determined by a feedback system which detects the position of frame 114) the group of rollers 40 on the side of the saw blade 36′ having the cut piece release to allow the cut piece to fall into the splitter section. The set of rollers on the opposite side of the saw does not release the uncut log.

FIGS. 10 and 11 show drive rollers 40 in detail. A bracket 116 is affixed to the basic frame 2 of the apparatus, perhaps by intervening structure, and a hydraulic cylinder 118 extends between bracket 116 and a second bracket 120. A plurality of sleeves 119 flank hydraulic cylinder 118 to provide additional support. Mounted to the second bracket 120 is a hydraulic motor 122 which is operatively connected to sprockets 124 by a chain 126. It will be appreciated that when the motor 122 operates, rollers 40 rotate. Hydraulic cylinder 118 is connected to a fluid control system to cause the rollers 40 to drive outwardly to engage the sides of a log with a predetermined force. This force is detected by a pressure sensor which sends a signal to a control circuit to maintain the predetermined force.

A plate 122′ is attached to bracket 122 and extends at an angle to the path of a log. Thus, if a log is inadvertently directed toward the roller on the lower part of FIG. 10, plate 122′ will prevent its getting caught by deflecting it.

FIG. 11 shows how the hydraulic cylinder 118 and sleeves 119 are spaced vertically to provide adequate support for the rollers 40.

FIGS. 12 through 14 illustrate how the splitting section operates. This section is located immediately below the cutting section, and saw blade 36′ is shown in phantom lines. A deflector plate 128 extends upwardly at a slight angle to the vertical and directs cut pieces of log into a V-shaped cradle 130 forming a dihedral angle of approximately 120 degrees. Since the cradle is V-shaped, the log will naturally align itself with the axis of the cradle. A splitting hydraulic cylinder 132 is attached at one end to beam 136 and at another end to a sliding pusher 134. Beam 136 is solidly attached to the frame, and plate 134 slides on beam 136. In the preferred embodiment, the sliding plate 134 is slidingly secured to an upper flat part of beam 136 by folded-over edges 138. Also attached to beam 136 on a side of cradle 130 opposite that of cylinder 132 is a wedge 140. It will be appreciated that as plate 134 is driven rightwardly, a cut piece will engage wedge 140 and be split. Wedge 140 can include a cross piece (not shown) having a vertical position to accomodate cut pieces of various diameters.

Split wood falls from the splitting section, engages a deflecting plate 142 (see FIG. 2) and is then incident on a lower part of the first conveyor 62 which carries the pieces to the second conveyor 64 which in turn loads them into a truck, or the like.

FIG. 15 shows an intercepting chute 144 which is used when it is not desired to split the cut wood pieces. The upper part of V-shaped cradle 30 (see FIGS. 12 and 13) includes notches 146, and the bottom part of intercepting chute 144 includes angled runners 148 which ride in notches 146 to allow intercepting chute 144 to be moved with respect to the splitting station. FIG. 16 shows how the intercepting chute 144 catches logs from the cutting station and directs them outwardly to chute 72 which has been moved from the position of FIG. 3 and placed between the discharge end of intercepting chute 144 and first conveyor 62.

FIG. 17 shows a hydraulic cylinder 150 which is attached to intercepting chute 144 and frame 2 to move the intercepting chute into an intercepting position or out of such a position.

FIG. 18 is a perspective view of the intercepting chute 144. A surface 152 is generally flat and slopes downwardly. Surfaces 154 are vertical and cooperate to direct the log along the flat surface 152 in such a manner that the log will not become caught. The particular design allows the intercepting chute to be moved as described without interference with other parts of the machine.

FIG. 19 is a top view of the first conveyor 62 and illustrates how log-engaging cleats 156 move along a V-shaped trough 158 to load cut pieces of wood. At one end, a deflecting shield 160 prevents wood coming down deflecting plate 142 from overshooting the lower end of conveyor 62. Deflecting shield 160 is preferably pivotally mounted to one edge of trough 158 (see FIG. 21) at a hinge 162. This allows the deflecting shield to be pivoted to an inward location during transportation.

FIG. 20 is a cross section taken along line 20—20 of FIG. 19 and shows how a chain 164 is driven by sprocket 166 and how cleats 156 are associated with the chain 164.

FIG. 21 shows an end view of the conveyor and illustrates the triangular nature of cleats 156.

FIGS. 22 through 26 illustrate operation of the second conveyor 64. A pillar 168 is mounted to the frame 2 and supports one end of the conveyor 64. A hydraulic cylinder 170 is attached to a movable part of the pillar 168 and to conveyor 64 to control the orientation of the conveyor with respect to the pillar 168.

FIG. 23 illustrates how the conveyor 64 can be oriented to load wood into a truck of almost any size by raising and rotating portion 172 of pillar 168 and extending hydraulic cylinder 170.

FIG. 24 is an end view showing curved sides 174 and movable belt 176 of conveyor 64. Hydraulic motor 178 drives the belt to move split wood along a conveyor 64.

FIGS. 25 and 26 illustrate how pillar 168 operates. A first movable part 172 is mounted about an inner cylinder 180, the inner cylinder 180 fitting in an annular slot 182 between inner and outer sections of the movable part 172. Slot 182 and inner cylinder 180 are splined to insure their rotation together. Attached to the inner part 184 of movable portion 172 are threaded blocks 186 and 188. A threaded shaft 190 is operated by hydraulic motor 200 so that when the shaft is rotated, the movable part 172 is driven upwardly as shown in FIG. 26.

Further, inner cylinder 180 is mounted for rotation with respect to frame 2, and a gear 202, which is attached to cylinder 180, is driven in rotation by a motor 204 which has a small gear 206 to engage gear 202. It will be appreciated that it is extremely simple to move conveyor 64 upwardly and orient it by simple control of motors 200 and 204 and hydraulic cylinder 170.

OPERATION

In operation, the machine is moved to the location of a plurality of logs, for example, by towing it with a tractor. The stabilizing pads are then extended, and the extensible part 22' of the log deck is extended. Conveyors 62 and 64 are oriented by operation of hydraulic cylinders 170 and 171, with the discharge end of conveyor 64 being adjacent a truck, or the like. Then, the operator directs boom 10 to the pile of logs and selects a log by grasping it with grappling element 20. The log is then placed on the log deck, and repeated operations place additional logs on the log deck. The operator then activates hydraulic cylinder 92 to cause a single log to be displaced from log deck 22 onto the plurality of hour-glass shaped rollers 30. Motors 32 are then activated to drive the logs forwardly whereupon they are grasped by the first set of rollers 40 located on the log deck side of the saw. The rollers 40 then drive the log until light beam 46 is broken, whereupon the set of rollers on the splitter side of the saw engage the log. Saw motor 38 is then activated to cause the blade to rotate, and hydraulic cylinder 112 causes the saw blade to cut through the log. When the saw has reached a lower point, determined by a condition-sensing switch, it returns to its initial position and at the same time the set of rollers on the splitting side of the saw releases the cut piece of wood, and it falls into the splitting section. A second light beam in the splitter causes activation of hydraulic cylinder 132 whereby the log is split.

The lengths of the cut pieces may be varied by moving the light source 42 and photocell 44 along the path determined by rollers 30. During operation, the rollers 40 on the log deck side of the saw drive the log forwardly until the log blocks light beam 42. It should be noted that the set of rollers on the log deck side of the saw do not release the log until the piece is entirely cut. The set of rollers 40 on the splitter side of the saw, however, sequentially grasp a log during the cutting operation and then release the cut piece to allow it to fall into the splitting section.

As the split logs fall beyond the wedge, they are directed to the bottom of conveyor 62 by deflecting plate 142. These pieces are then carried by the conveyor elements to a truck.

If it is desired not to split the cut pieces of wood, intercepting chute 144 is moved into position, and chute 72 is placed such that cut, but unsplit, pieces of wood from intercepting chute 144 are directed to the lower part of first conveyor 62.

It will be appreciated that modifications of the invention within the scope of the appended claims will be apparent to those skilled in the art.

What is claimed is:

1. Apparatus for cutting wood comprising loading means for grasping a log and carrying it to a log deck means, said log deck means comprising means for storing a plurality of logs and means for selectively releasing a single log to a plurality of roller means for advancing said single log along a path, saw means for cutting said single log into a plurality of pieces and located at one end of said path, said apparatus being portable and wherein said log deck means comprises a fixed portion and an extensible portion, said extensible portion being movable with respect to said fixed portion, wherein said means for selectively releasing a single log comprises shaft means rotatably mounted and carrying a plurality of cam means for engaging said logs, said shaft means comprising a first part movable with respect to a second part, said first part being attached to said fixed portion of said log deck and said second part being attached to said extensible portion.

2. Apparatus according to claim 1 wherein said roller means comprises drive means for engaging said single log and for moving it along said path, said saw means further comprising a saw controlled by position detection means for determining the location of said single log and for operating said saw when said single log is at a preselected location.

3. Apparatus according to claim 2 wherein said saw further comprises speed control means for controlling the velocity of a cutting edge with respect to said log in accordance with the rate of advance of said cutting edge through said log.

4. Apparatus according to claim 3 wherein said cutting element is circular and said speed control means comprises means for determining the rotational velocity of said cutting element.

5. Apparatus according to claim 2 wherein said position detection means comprises a beam of light directed across said path and a photodetector, said photodetector detecting when said single log blocks said beam of light.

6. Apparatus according to claim 2 wherein said drive means comprises a plurality of rollers each of which is mounted for rotation about a respective one of a plurality of parallel vertical axes, at least one of said rollers comprising means for driving said one roller about a respective one of said axes.

7. Apparatus for cutting wood comprising loading means for loading a log on log deck means, a plurality of roller means for advancing said log along a path, saw means for cutting said log into a plurality of pieces, said roller means comprising drive means for engaging said log and for moving it along said path, said drive means comprising a plurality of rollers each of which is mounted for rotation about a respective one of a plurality of parallel vertical axes, at least one of said rollers comprising means for driving said one roller about a respective one of said axes, wherein said plurality of rollers are mounted in first and second groups of said rollers, said first group being on a first side of said saw remote from said log deck and a second group being on a second side of said saw adjacent said log deck, each of said first and second groups being mounted for movement in a direction transverse to said path, said first group being adapted to hold said single log during a cutting operation and to release a cut piece of said single log after said cutting operation.

8. Apparatus according to claim 2 further comprising splitting means below said saw means for receiving cut pieces of said single log and splitting said pieces into split pieces wherein said splitting means comprises a wedge and means for forcing said pieces against said wedge in response to a control signal.

9. Apparatus for cutting wood comprising loading means for loading a log on log deck means, a plurality of roller means for advancing said log along a path, saw means for cutting said log into a plurality of pieces, said roller means comprising drive means for engaging said log and for moving it along said path, said apparatus further comprising splitting means below said saw means for receiving cut pieces of said single log and splitting said pieces into split pieces, wherein said splitting means comprises a wedge and means for forcing said pieces against said wedge in response to a control signal, and conveyor means for receiving said split pieces and carrying said split pieces to a loading location, wherein said conveyor means comprises opposed sidewalls extending in a first direction and slanted toward a center line of said conveyor means, said center line extending in said first direction.

10. Apparatus for cutting wood comprising loading means for loading a log on log deck means, a plurality of roller means for advancing said single log along a path, saw means for cutting said log into a plurality of pieces, said apparatus further comprising splitting means below said cutting saw means for receiving cut pieces of said single log and splitting said pieces into split pieces, and chute means for receiving said cut pieces and directing said cut pieces away from said splitting means, said chute means being movable to a first position between said saw means and said splitting means to receive said cut pieces and a second position wherein said cut pieces are received by said splitting means.

11. Apparatus according to claim 2 further comprising operator means for allowing an operator to control the operation of said loading means, said means for storing, and said means for advancing.

12. Apparatus according to claim 11 wherein said saw means, said drive means, and a splitter means for splitting cut pieces comprise means for automatic operation whereby when a log is engaged by said drive means said saw means will automatically operate to cut said single log into said pieces and said splitter will automatically operate to split cut pieces.

13. Apparatus for cutting wood comprising frame means, operator means at one end of said frame means comprising a control means for controlling operation of said apparatus, loading means for engaging a log and moving said log, log deck means for receiving said log and for selectively allowing said log to move to a first location, first roller means at said first location for receiving said log and moving it along a path, drive roller means adjacent an end of said first roller means for engaging said log and moving one end of said log into a cutting station, second roller means for engaging an end portion of said log when said log is in said cutting station and for holding said end portion during a cutting operation and for releasing said end portion upon completion of said cutting operation, saw means for performing said cutting operation, conveyor means below said cutting station for receiving said end portion after said end portion has been cut from said log and after said second roller means has released said end portion to move said cut end portion to a predetermined location.

14. Apparatus according to claim 13 further comprising splitter means between said cutting station and said conveyor means for splitting said cut end portion into split pieces and for directing said split pieces to said conveyor means.

* * * * *